US006260817B1

(12) United States Patent
Lam et al.

(10) Patent No.: US 6,260,817 B1
(45) Date of Patent: Jul. 17, 2001

(54) HYDRAULIC BLOWOUT PREVENTER ASSEMBLY FOR PRODUCTION WELLHEAD

(75) Inventors: Tony M. Lam; Keith D. Farquharson, both of Edmonton (CA)

(73) Assignee: Stream-Flo Industries, Ltd., Edmonton (CA)

( * ) Notice: Subject to any disclaimer, the term of this patent is extended or adjusted under 35 U.S.C. 154(b) by 0 days.

(21) Appl. No.: 09/431,713

(22) Filed: Oct. 29, 1999

(51) Int. Cl.[7] ..... E21B 33/06
(52) U.S. Cl. ..... 251/1.3; 251/63
(58) Field of Search ..... 251/1.1, 1.2, 1.3, 251/63; 166/85.4, 84.3

(56) References Cited

U.S. PATENT DOCUMENTS 2,642,942 * 6/1953 Reynolds ..... 251/1.1 X
3,554,480 * 1/1971 Rowe ..... 251/1.3
3,817,326 * 6/1974 Meynier, III ..... 251/1.3 X
4,240,503 * 12/1980 Holt, Jr. et al. ..... 251/1.3 X
4,770,387 * 9/1988 Granger ..... 251/1.3
4,969,390 * 11/1990 Williams, III ..... 251/1.3 X
5,224,557 * 7/1993 Yenulis et al. ..... 251/1.1 X

FOREIGN PATENT DOCUMENTS 2197584 7/1998 (CA) .

OTHER PUBLICATIONS

"Regan Blowout Prevents", Regan Forge & Engineering Company, San Pedro, California (brochure), pp. 3704–3705.

* cited by examiner

*Primary Examiner*—Kevin Shaver
*Assistant Examiner*—Eric Keasel
(74) *Attorney, Agent, or Firm*—Sheridan Ross P.C

(57) ABSTRACT

In the hydraulic blowout preventer of an integral production wellhead, the ram chambers and hydraulic fluid supply line are both buried or formed in the side wall of the blowout preventer.

5 Claims, 5 Drawing Sheets

HYDRAULIC BLOWOUT PREVENTER ASSEMBLY FOR PRODUCTION WELLHEAD

FIELD OF THE INVENTION

The present invention relates to a hydraulic production blowout preventer ("BOP"), its utilization as part of an integral production wellhead tree and the provision of BOP ram hydraulic chambers and a hydraulic fluid supply passageway which are positioned within the body of the tree.

BACKGROUND OF THE INVENTION

A typical, commercially available, prior art hydraulic BOP, incorporated into a conventional production wellhead tree, is illustrated in FIG. 1. It will be noted that the assembly involves:

- a BOP housing which forms opposed horizontal ram chambers and has threaded side connections, the BOP housing further having threaded top and bottom connections for connecting with other components of the production wellhead;
- the BOP housing also forms a vertical central fluid production bore extending therethrough and the ram chambers extend between the external surface of the housing and the bore;
- the ram chambers each contain a sealed ram comprising an inner elastomeric element and an outer, steel body;
- a pair of external housings are connected to the side connections; and
- each external housing forms an internal space or chamber which contains a sealed piston which supports a return spring—the piston is connected with the ram and a port is formed in the external housing outer end wall, for connection with a hydraulic line;
- whereby hydraulic fluid, supplied under pressure to the external housing through the hydraulic line, advances the piston to drive the ram into the wellhead bore to assume a closed position for sealing around a rod string (not shown) and the return spring retracts the ram and piston to an open position when the hydraulic pressure is released.

It will be noted that the external housings form the hydraulic chambers for the BOP and must be fluid tight and of sturdy enough structure to contain the hydraulic pressure.

In a recent development, an integral production wellhead tree was disclosed in Canadian Patent No. 2,197,584, (the "'584 patent"), issued to the present applicant. This tree, shown in FIG. 2, involves integrating BOP and flow tee housings between top and bottom tubing head connections, as a unitary steel body. More particularly the tree comprises a forged or cast one-piece body forming a vertical fluid production bore and incorporates:

- a bottom connection adapted to connect and seal with a tubing head;
- a BOP housing, whose side wall forms opposed side openings or chambers for containing BOP rams, which chambers communicate or connect with the fluid production bore—it will be noted that the chambers can be described as being 'buried' in the side wall;
- a flow tee housing forming a side opening communicating with the bore and having means for connecting with a flow line; and
- a top connection for sealing and connecting with the next component of the production wellhead, usually a stuffing box.

The tree of the '584 patent further has a generally cylindrical configuration, which results in a relatively thick side wall when compared with prior production wellheads.

SUMMARY OF THE INVENTION

The present invention is concerned with providing a production wellhead assembly comprising:

- an integral production wellhead tree having a BOP housing;
- the side wall of the BOP housing forming a pair of horizontal opposed chambers, each extending between the housing's external surface and the tree's vertical bore;
- the side wall of the tree forming a first passageway means, extending between the tree's external surface and the outer end of each chamber, through which hydraulic fluid may be supplied under pressure;
- preferably a BOP ram and piston assembly is positioned within each chamber;
- whereby hydraulic fluid may be supplied through the first passageway means to the chambers to bias the ram and piston assemblies to a closed position;
- a pair of external housings is disengagably secured to the BOP housing side wall for closing and sealing the outer ends of the chambers;
- each external housing preferably forms a sealed internal space or chamber;
- preferably a shaft element is connected with each ram and piston assembly and extends into the internal space of the associated external housing; and
- return means, such as a spring, are preferably provided in each external housing internal space, for acting on the shaft element to bias the ram and piston assembly to the open position.

It is to be noted:

- that the BOP ram and piston are provided as assemblies which are wholly located within the housing chambers;
- that the chambers and the hydraulic fluid passageway (which both must contain pressure) are buried within the tree side wall; and
- that the external housings do not necessarily have to be constructed so as to contain pressure.

In addition, the assembly lends itself to a preferred combination with additional mechanical means for closing and locking the rams in the closed position as a safety "override". More particularly, means, such as a threaded bolt, may be mounted to the external housing and extend into the housing's chamber, for biasing the shaft element and ram to the closed position and locking them there.

In a variant of the foregoing, the passageway means may be extended from the BOP housing through the external housing wall, to communicate with the external housing chamber at its outer end. When the shaft element is sealed to the external housing side wall, it now is converted to a piston. The hydraulic fluid pressure can then be applied not only to the outer face of the ram piston assembly but also to the shaft element piston outer face, thereby increasing the closing force. In this case, the external housing would, of course, have to be capable of containing the fluid pressure. However the assembly still lends itself to use with the mechanical override means.

In another variant, a second passageway means is formed through the BOP housing side wall and external housing side wall to supply hydraulic fluid into the external housing chamber to act against the inner face of the piston, thereby permitting the assembly to be opened with hydraulic fluid.

Broadly stated, the invention is directed to an improvement in a production wellhead assembly, comprising: an integral production wellhead tree having a side wall, an external surface and a fluid production bore extending therethrough; the tree comprising a hydraulic blowout preventer ("BOP") housing having a side wall and external surface; the BOP housing side wall forming a pair of opposed chambers, having inner and outer ends, extending between the housing external surface and the bore, each chamber being operative to receive a sealed ram and piston assembly slidable between open and closed positions; the tree side wall forming hydraulic fluid supply first passageway means extending between the tree external surface and the outer end of each chamber, so that hydraulic fluid may be supplied therethrough to advance the ram and piston assemblies into the bore to the closed position; and means, disengagably secured to the BOP housing side wall, for closing and sealing the outer ends of the chambers.

DESCRIPTION OF THE PREFERRED EMBODIMENT

Figure 1:
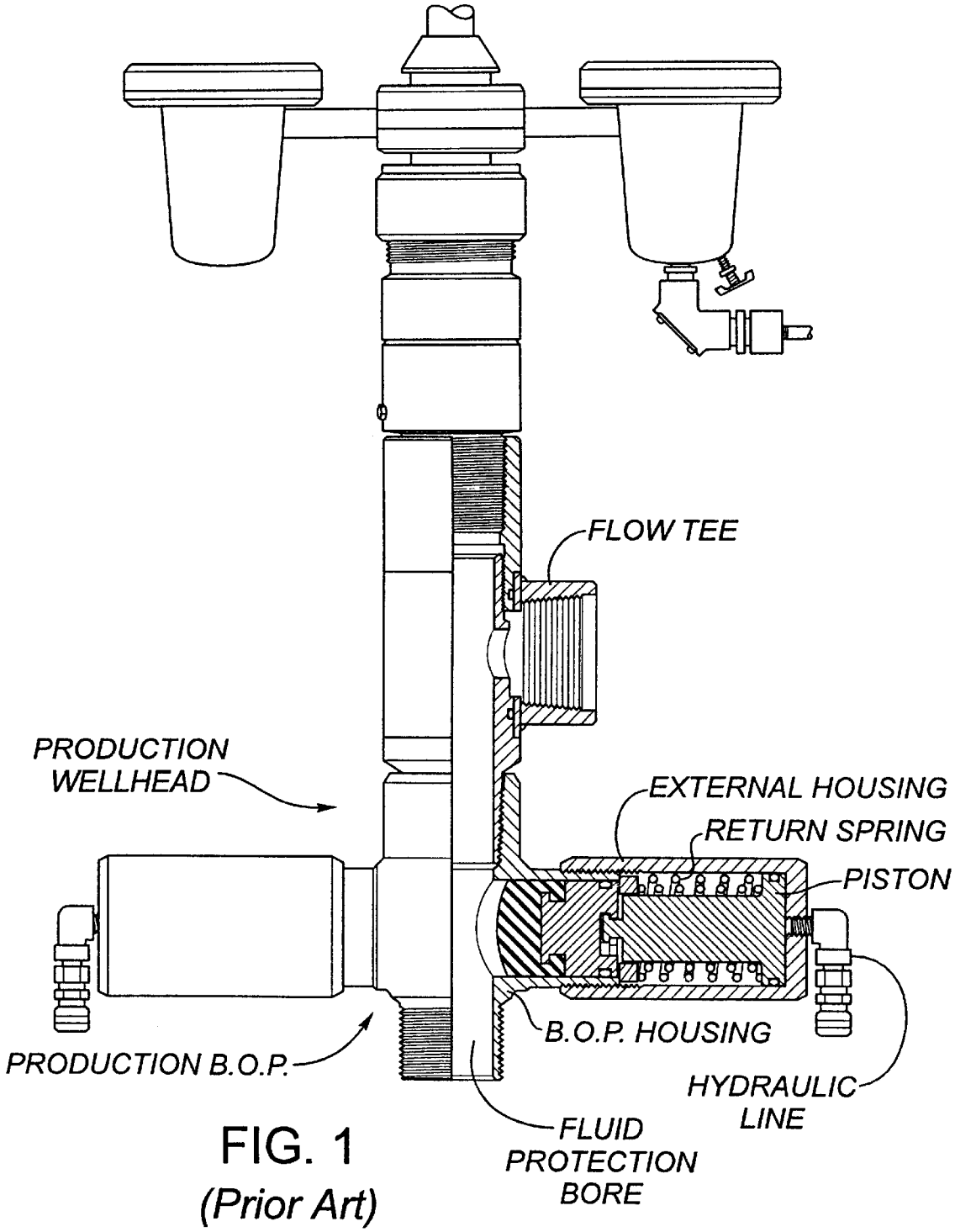
FIG. 1 (Prior Art)
FIG. 1 is a side view, partly in section, showing a typical prior art production wellhead tree incorporating a hydraulic production BOP.
Figure 2:
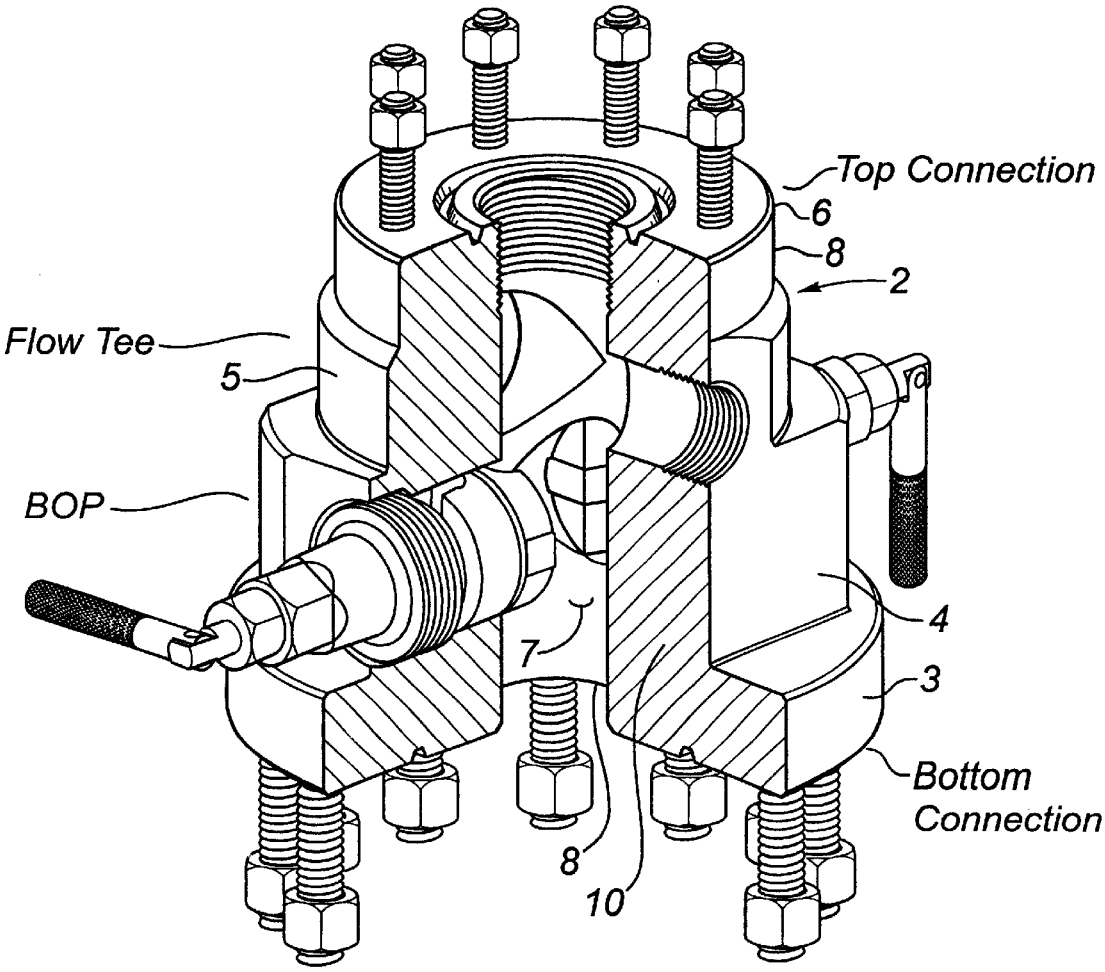
FIG. 2 (Prior Art)
FIG. 2 is a perspective view, partly in section, showing a prior art integral production wellhead tree incorporating a bottom connection, mechanical BOP, flow tee and top connection.
Figure 3:
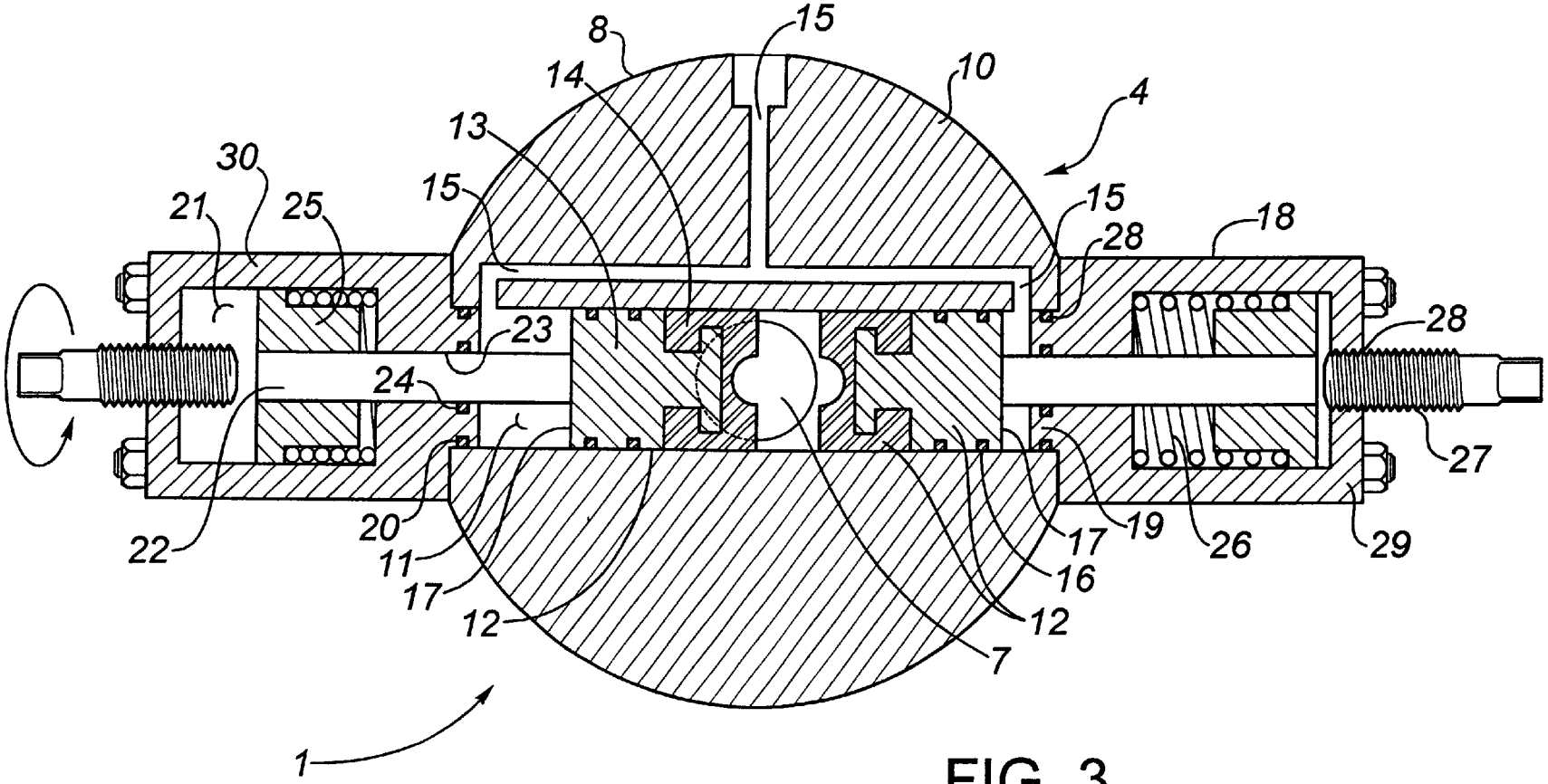
FIG. 3 is a top plan view, in section, showing a hydraulic BOP in accordance with the invention, which structure incorporates a hydraulic fluid passageway buried in the BOP housing side wall and a mechanical BOP override means. The figure further shows a pair of sealed rams in the opened and closed positions, and a pair of external housings, each containing a return spring.

In the embodiment shown in FIG. 3, we provide a hydraulic production BOP 1 which is incorporated into an integral production wellhead tree 2.

The tree 2 comprises, in sequence from the bottom to the top, a bottom connection 3, a BOP housing 4, a flow tee housing 5 and a top connection 6. The bottom connection 3 is sized and adapted to connect and seal with the top connection of a tubing head (not shown). The top connection 6 is sized and adapted to connect and seal with the bottom connection of a stuffing box (not shown). The tree 2 has a vertical., axial, substantially cylindrical fluid production bore 7 extending therethrough. The external surface 8 of the tree 2 is substantially cylindrical.

The tree's BOP housing side wall 10 forms a pair of opposed, horizontal, cylindrical chambers 11 extending between the external surface 8 and the bore 7. These buried chambers 11 function to receive a pair of BOP ram and piston assemblies 12. Each assembly 12 comprises an outer steel body or piston 13 connected with an inner elastomer section or ram 14, commonly referred to as the "rubber". The ram and piston assemblies 12 are slidable within the chambers 11 between open and closed positions illustrated in FIG. 3.

A hydraulic fluid supply first passageway means 15 is formed by the BOP housing side wall 10. It extends from the external surface 8 to the outer ends of the ram chambers 11 and is buried in the side wall 10. The ram and piston assemblies 12 are sealed in conventional fashion with O-ring seals 16.

An external housing 18 is disengagably secured (as by threads) to the BOP housing side wall 10 at the outer end of each ram chamber 11. Each external housing 18 has an inner end wall 19 which extends across the end opening 20 of its associated ram chamber 11. An O-ring seal 28 forms part of the external housing 18 and seals the end wall 19 with the BOP housing side wall 10. Thus the external housing 18 provides means for closing and sealing the outer end of its associated ram chamber 11.

Thus pressurized hydraulic fluid can be supplied through the first passageway means 15 to act against the outer end faces 17 of the ram and piston assemblies 12, to thereby advance the rams to the closed position in which they extend into the bore 7 to close about a rod string (not shown).

Each external housing 18 forms an enclosed space or chamber 21.

A shaft element 22 is connected to each ram and piston assembly 12. The shaft element 22 extends through an opening 23, formed in the adjacent external housing inner end wall 19, into the chamber 21 of its associated external housing 18. An O-ring seal 24 seals between the shaft element 22 and the end wall 19. At its outer end, the shaft element 22 has an expanded diameter body 25. A return spring 26 is contained within the chamber 21 and is supported by the shaft element body 25. The spring 26 provides means for normally urging the shaft element 22 and ram and piston assembly 12 to the open position.

A threaded bolt 27 extends through a threaded opening 28 in the outer end wall 29 of each external housing 18. The bolts 27 can be turned to bias the ram and piston assemblies 12 into the closed position and lock them there. The bolts 27 therefore each provide mechanical means for advancing an associated shaft element and ram and piston assembly to the closed position and locking it in that position.

In operation therefore, pressurized hydraulic fluid can be fed through the first passageway 15 to bias the ram and piston assemblies 12 to the closed position. During this action, the shaft element 22 compresses the return spring 26. The bolts 27 may be advanced to lock the assemblies 12 in place. If the assemblies 12 are not locked in this manner, upon opening of the passageway 15 and release of the hydraulic pressure, the return spring 26 will return the assemblies 12 to the open position.

Figure 4:
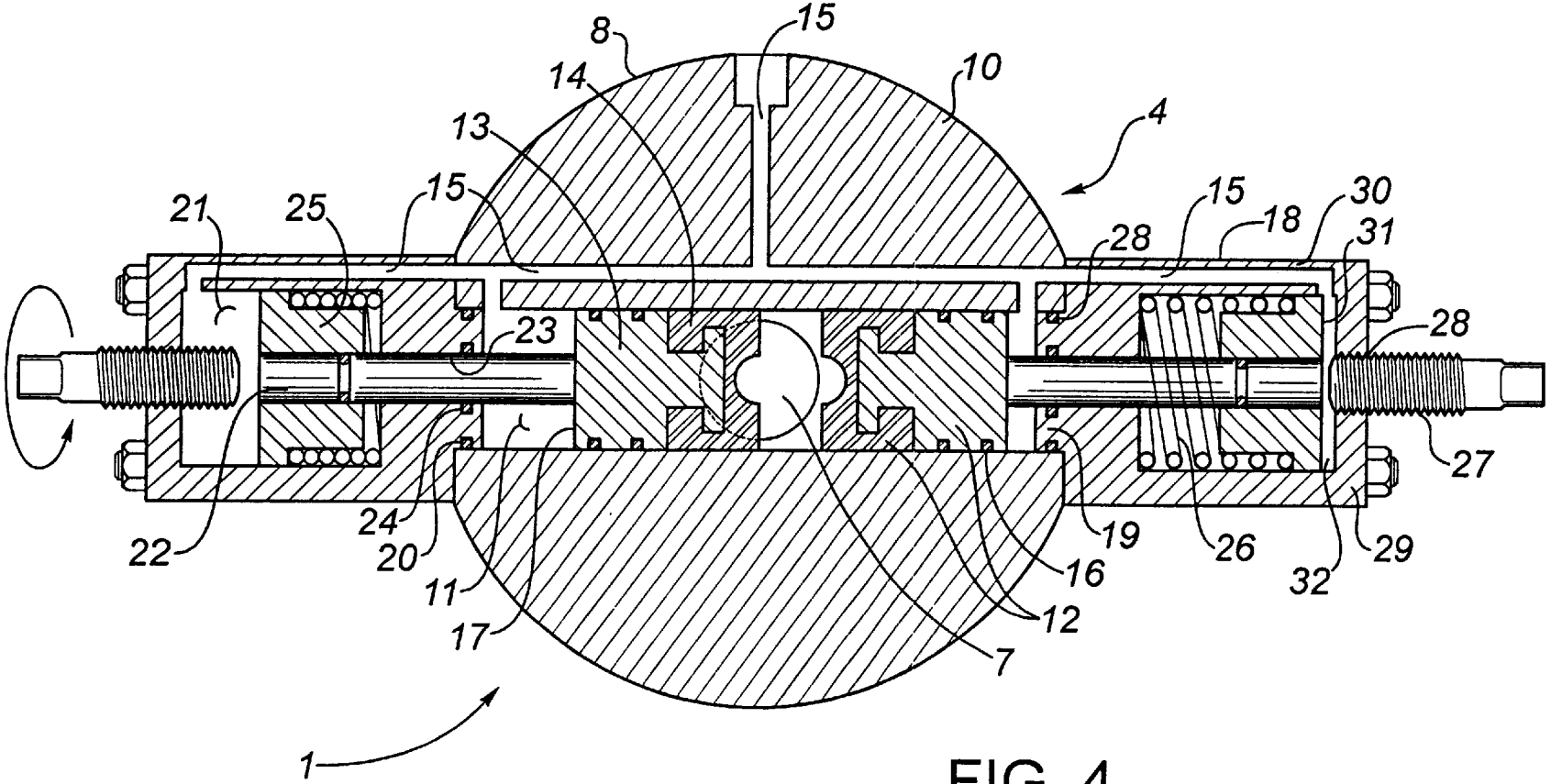
FIG. 4 is a view similar to FIG. 3 but further showing a hydraulic fluid passageway extending through the external housing side wall into the outer end of the external housing chamber.

In an alternative variant, shown in FIG. 4, the first passageway 15 further extends through the external housing side wall 30 and communicates with the outer ends 31 of the external housing chambers 21. As a result, pressurized hydraulic fluid may be applied to both the ram and piston assembly outer end faces 17 and the shaft element outer end faces 32 for the purpose of biasing the assemblies 12 to the closed position. Otherwise stated, this variant involves dual chamber actuation to close, with spring return to open.

Figure 5:
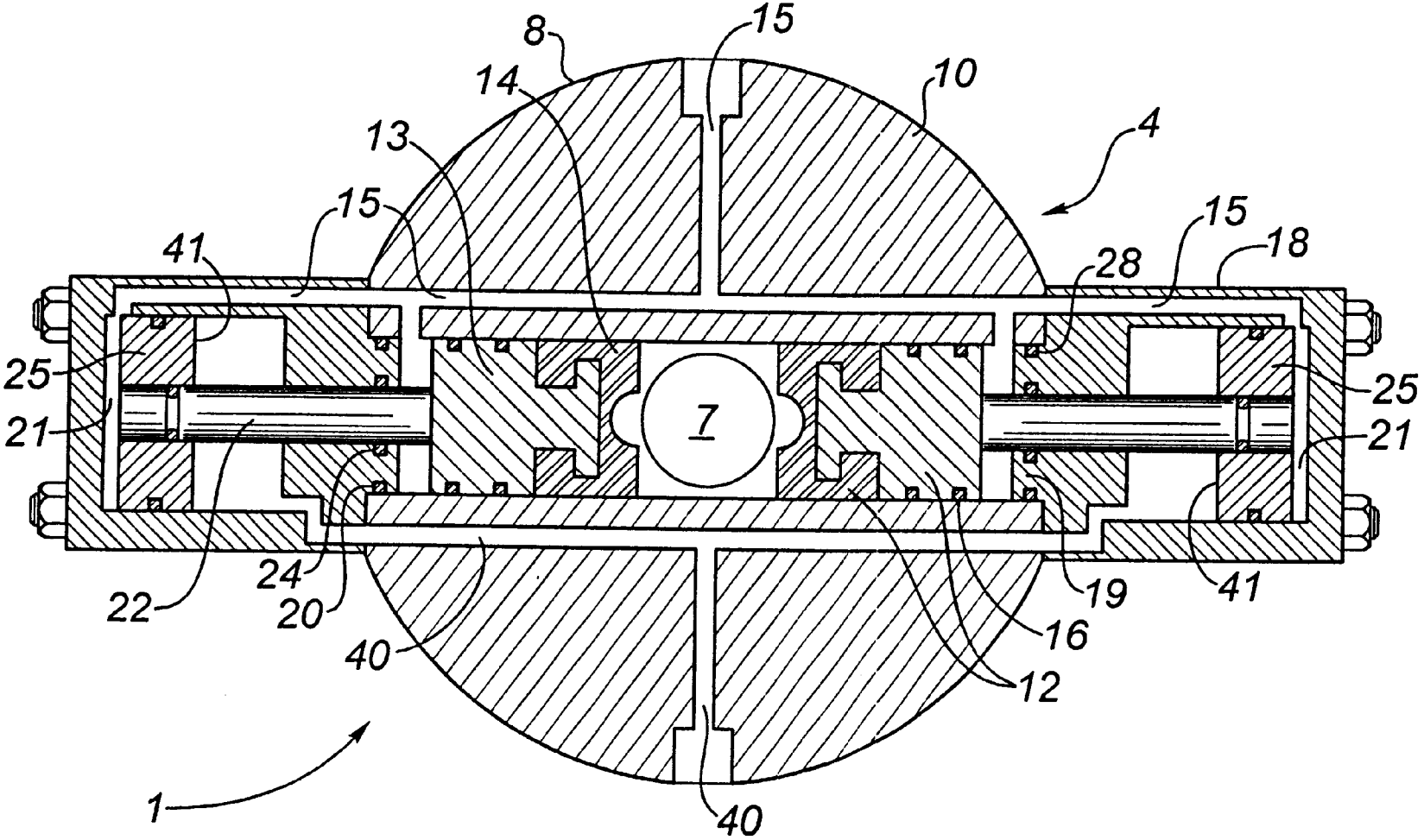
FIG. 5 is a view similar to FIG. 4 but further showing a second hydraulic fluid passageway buried in the BOP housing side wall and extending into or communicating with the inner end of the external housing chamber.

In another variant, shown in FIG. 5, a second passageway means 40 is formed through the BOP housing side wall 10. The passageway means 40 extends from the external surface 8 to the inner ends of the external housing chambers 21. Thus pressurized hydraulic fluid may be delivered through the buried passageway means 40 to act against the inner end faces 41 of the shaft element expanded diameter bodies 25, to hydraulically open or retract the rams 12.

From the foregoing, it will be noted that the invention is characterized by the following advantages:

the hydraulic lines at the wellhead are buried inside the BOP body;

the likelihood of damage is minimized and;

the external housing no longer has to contain pressure and its size and cost are reduced.

What is claimed is:

1. A production wellhead assembly, comprising:

an integral production wellhead tree having a side wall, an external surface and a fluid production bore extending therethrough;

the tree comprising a hydraulic blowout preventer ("BOP") housing having a side wall and external surface;

the BOP housing side wall forming a pair of opposed chambers, having inner and outer ends, extending between the housing external surface and the bore, each chamber containing a sealed ram and piston assembly slidable between open and closed positions;

the tree side wall forming hydraulic fluid supply first passageway means extending between the tree external surface and the outer end of each chamber, so that hydraulic fluid may be supplied therethrough to advance the ram and piston assemblies into the bore to the closed position; and means, disengagably secured to the BOP housing side wall, for closing and sealing the outer ends of the chambers.

2. The production wellhead assembly as set forth in claim 1 comprising:

a pair of disengageable external housings, each closing and sealing the outer end of one of the chambers, said external housings each forming a sealed internal space and having inner and outer ends;

a shaft element connected with the outer end of each ram and piston assembly and extending into the internal space of an associated external housing; and said tree side wall forming hydraulic fluid supply second passageway means, extending between the tree external surface and the inner end of each housing internal space, so that hydraulic fluid may be supplied therethrough to retract the ram and piston assemblies to the open position.

3. The production wellhead assembly as set forth in claim 1 wherein the means for closing and sealing the outer ends of the chambers comprises a pair of disengageable external housings, each closing and sealing the outer end of one of the chambers, with which it is associated;

said external housings each forming a sealed internal space;

said wellhead assembly further comprising:

a pair of shaft elements, each connected with a ram and piston assembly and extending into the internal space of its associated external housing; and means, contained within each external housing internal space, for normally urging the shaft element and ram and piston assembly to the open position.

4. The production wellhead assembly as set forth in claim 3 comprising:

a pair of mechanical means, each connected with one of the external housings, operative to bias the shaft element and ram and piston assembly to the closed position and lock them in that position.

5. The production wellhead assembly as set forth in claim 4 wherein:

each shaft element is sealed to its associated external housing; and the first passageway means is further connected with each external housing space outwardly of the sealed shaft element;

whereby hydraulic fluid may act simultaneously against each of the ram and piston assemblies and the shaft elements to close the ram and piston assemblies.

* * * * *